US005660586A

United States Patent [19]

Chiu et al.

[11] Patent Number: 5,660,586

[45] Date of Patent: Aug. 26, 1997

[54] VARIABLE DISCHARGE WINDOW FAN

[75] Inventors: Bernard Chiu, Wellesley; John Longan, Shrewsbury, both of Mass.

[73] Assignee: Duracraft Corporation, Southborough, Mass.

[21] Appl. No.: 532,197

[22] Filed: Sep. 22, 1995

[51] Int. Cl.[6] ..... F24F 7/013

[52] U.S. Cl. ..... 454/200; 454/285

[58] Field of Search ..... 454/200, 202, 454/208, 210, 285, 153

[56] References Cited

U.S. PATENT DOCUMENTS

| | | | |
|---|---|---|---|
| 2,081,107 | 5/1937 | Kilb et al. | 454/200 |
| 4,084,491 | 4/1978 | Spotts et al. | 454/285 |
| 5,242,325 | 9/1993 | Nukushina | 454/285 |
| 5,425,671 | 6/1995 | Cunning | 454/200 X |

FOREIGN PATENT DOCUMENTS

| | | | |
|---|---|---|---|
| 60-178242 | 9/1985 | Japan | 454/285 |
| 61-289259 | 12/1986 | Japan | 454/285 |
| 62-147257 | 7/1987 | Japan | 454/285 |

*Primary Examiner*—Harold Joyce
*Attorney, Agent, or Firm*—John E. Toupal; Harold G. Jarcho

[57] ABSTRACT

A portable electric fan including a housing having inlet and outlet openings and adapted for mounting in an open window, a movable blade mechanism retained in the housing and operable to supply air through the open window between the inlet and outlet openings and a blade drive operatively coupled to the blade mechanism. Also included is a movable air director mechanism for directing in variable horizontal and vertical directions air supplied by the blower mechanism and an air director drive operatively coupled to the air director mechanism and operable to automatically vary the discharge directions.

9 Claims, 4 Drawing Sheets

VARIABLE DISCHARGE WINDOW FAN

BACKGROUND OF THE INVENTION

This invention relates generally to a portable electric fan and, more particularly, to a portable electric window fan.

Portable electric fans are used extensively to reduce personal discomfort caused by excessive temperatures. Some portable electric fans are designed specifically for mounting in open windows of inhabited enclosures and are typically operable to either exhaust air from the enclosure or direct outside air thereinto. Although generally quite efficient for establishing desirable air circulation between inside and outside of a particular enclosure, prior window fans have failed to provide fully satisfactory air flow patterns because of positional mounting limitations. For example, conventional window fans do not provide the variety of air flow distribution patterns furnished by portable floor or table fans that can function in a wider variety of positions. Also, the requirement in window fans for oppositely directed inlet and outlet openings presents problems not present in other environmental conditioning devices such as air conditioners.

In efforts to extend air circulation patterns, some prior fans have been provided with automatically movable frames. For example, U.S. Pat. No. 2,786,627 discloses a portable fan with an oscillating fan blade. However, such prior portable fans have not been capable of producing efficient air movement through an open window.

The object of this invention, therefore, is to provide an improved, more versatile portable window fan.

SUMMARY OF THE INVENTION

The invention is a portable electric fan including a housing having inlet and outlet openings and adapted for mounting in an open window, a movable blade mechanism retained in the housing and operable to supply air through the open window between the inlet and outlet openings and a blade drive operatively coupled to the blade mechanism. Also included is a movable air director mechanism for directing in variable horizontal and vertical directions air supplied by the blower mechanism and an air director drive operatively coupled to the air director mechanism and operable to automatically vary the discharge directions. The effective operating range of the fan is extended by the air director mechanism.

According to one feature of the invention, the air director mechanism includes a plurality of movable air director vanes. A desirable variable air discharge pattern is produced efficiently by the movable vanes.

According to another feature of the invention, the air director vanes include a plurality of spaced apart vertically oriented vanes mounted for horizontal oscillating movement. The vertically oriented vanes provide a variable horizontal discharge pattern.

According to yet another feature of the invention, the air director vanes further include a plurality of spaced apart horizontally oriented vanes mounted for vertical oscillating movement. The horizontally oriented vanes provide a variable vertical discharge pattern.

According to an additional feature of the invention, the fan includes a control for selectively activating the air director drive to independently activate the vertically oriented vanes and the horizontally oriented vanes. Operational versatility is enhanced by the control.

According to further features of the invention, the air director drive includes a vertical drive motor for producing the vertical oscillating movement of the horizontally oriented vanes and a horizontal drive motor for producing the horizontal oscillating movement of the vertically oriented vanes, and the control includes an electrical circuit for selectively and independently energizing the vertical drive motor and the horizontal drive motor. Desirable independent vane control is provided efficiently by the drive motors and control circuit.

According to an additional feature of the invention, the vertically oriented vanes are disposed between the inlet opening and the horizontally oriented vanes to enhance air flow patterns and construction ease.

According to further features of the invention, the housing has side walls, a bottom wall for mounting on a sill of the window, a top wall for engaging a sash of the window, a front wall defining the air outlet opening, and a rear wall defining the air inlet opening; the fan includes a wing wall extendable out of each of the side walls; and the top wall defines spaced apart surfaces for straddling the window sash. These features facilitate an air tight, secure mounting of the fan in an open window.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 5:
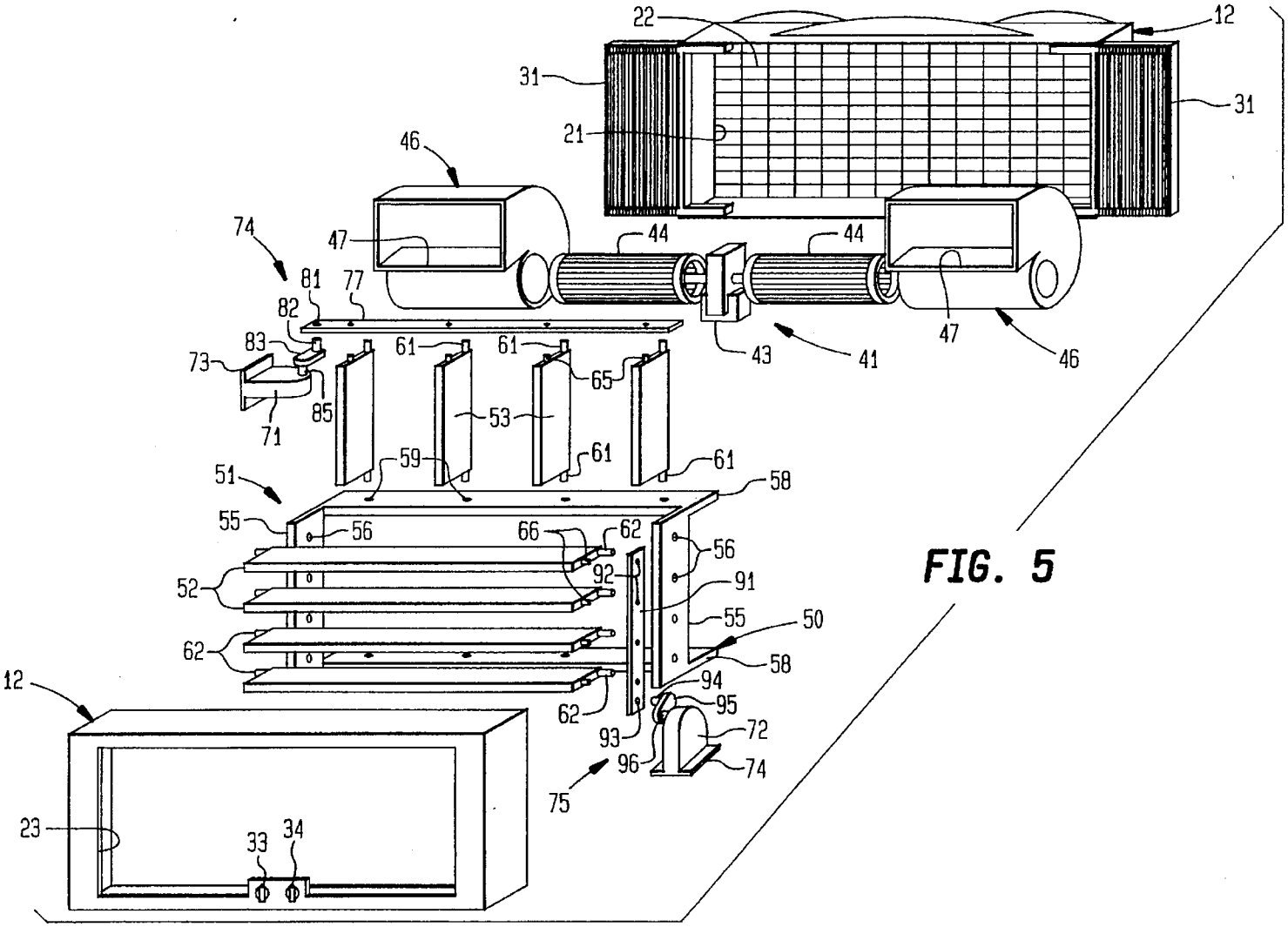
FIG. 5 is an exploded view of the fan depicted in FIG. 1.

A portable electric fan 11 has a housing 12 with a top wall 13, a bottom wall 14, a rear wall 15, a front wall 16 and side walls 17. The rear wall 15 defines an inlet opening 21 covered by a grill 22 and the front wall 16 defines an outlet opening 23. Defined by the top wall 13 are a pair of upwardly projecting longitudinally aligned rear tabs 25 and an upwardly projecting front tab 26 transversely spaced from the rear tabs 25. The front tab 26 forms a rearwardly facing surface 28 and the rear tabs 25 form forwardly facing surfaces 29. Projecting from each of the side walls 17 is an extendable wing wall 31 of a type disclosed in U.S. Pat. No. 5,382,136. An air director selector switch 33 and a speed control selector switch 34 are mounted on the front wall 16. Retained within the housing 12 is an air supply blade mechanism 41 illustrated in FIG. 5. The movable blade mechanism 41 includes an electric motor 42 supported by a motor mount 43 and operatively coupled to a pair of straddling blower wheels 44. Supporting each of the blower wheels 44 is a blower housing 46 defining an air discharge opening 47 facing the outlet opening 23 and operable to produce air flow between the inlet opening 21 and the outlet opening 23.

Also retained within the housing 12 is an air director mechanism 51 (FIG. 5) including a plurality of vertically spaced apart, horizontally oriented movable vanes 52 and a plurality of horizontally spaced apart, vertically oriented movable vanes 53. The vertically oriented vanes 53 are disposed between the inlet opening 21 and the horizontally oriented vanes 52. Supporting the horizontal vanes 52 and the vertical vanes 53 is a frame 55 disposed between the blower mechanism 41 and the outlet opening 23. The frame 55 includes a pair of horizontally spaced apart vertical flanges 55 defining support holes 56 and a pair of vertically spaced apart horizontal flanges 58 defining support holes 59. Extending from opposite edges at one end of each vertical vane 53 are axially aligned support stems 61 that are rotatably received by aligned support holes 59 in the horizontal flanges 58. Similarly, one end of each horizontal vane 52 has axially aligned support stems 62 projecting from opposite edges and rotatably received by aligned support holes 56 in the vertical flanges 55. Also projecting from an edge of each vertical vane 53 at an end thereof opposite a support stem 61 is a drive pin 65. A similar drive pin 66 projects from an edge of each horizontal vane at an end opposite to a support stem 62.

The air director mechanism 51 (FIG. 5) also includes a pair of synchronous drive motors 71, 72 mounted within the housing 12 by support brackets 73, 74, respectively. Operatively coupling the drive motor 71 to the vertical vanes 53 is a drive coupling 74 while the drive motor 72 is operatively coupled to the horizontal vanes 52 by a drive coupling 75. The drive coupling 74 has a linkage bar 77 with a plurality of spaced apart apertures 78 each receiving a drive pin 65 on a different vertical vane 53. Also defined by the plate 77 is an opening 81 that loosely receives an arm 82 on a drive cam 83 fixed for rotation with a drive shaft 85 on the motor 71. Energization of the drive motor 71 produces rotation of the cam 83 and the drive arm 82. That movement of the arm 82 produces reciprocating movement of the plate 77 and resultant oscillation of the vertical vanes 53 about the support stems 61. Similarly, the coupling 75 includes a linkage bar 91 having spaced apart apertures 92 each receiving the drive pin 66 on a different horizontal vane 52 and an opening 93 that receives an arm 94 on a cam 95 fixed for rotation with a drive shaft 96 of the motor 72. Energization of the motor 72 produces rotation of the cam 95 and resultant reciprocating movement of the bar 91 to in turn cause oscillating movement of the horizontal vanes 52 about the support stems 62.

Figure 1:
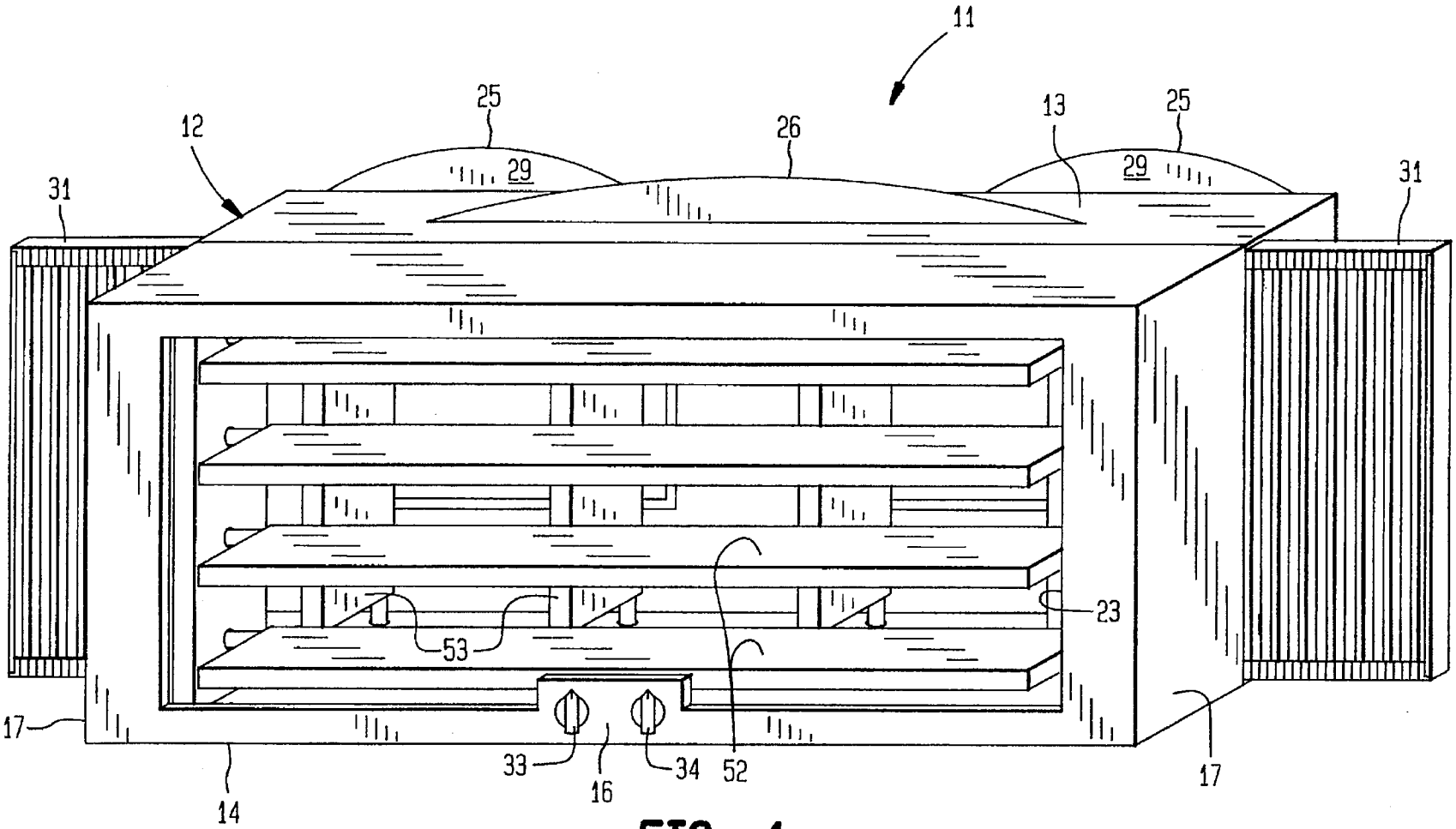
FIG. 1 is a front perspective view of a fan according to the invention.
Figure 3:
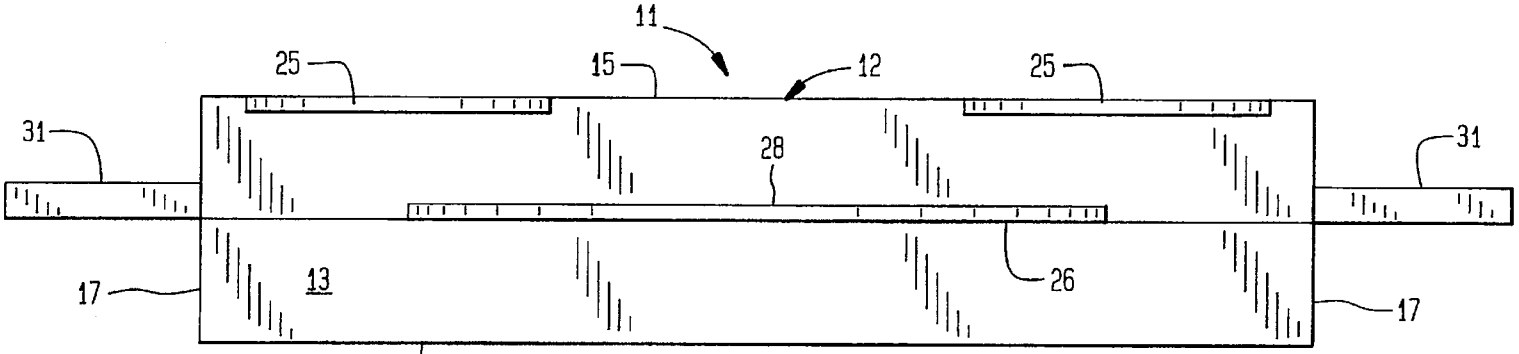
FIG. 3 is a top view of the fan illustrated in FIG. 1.
Figure 2:
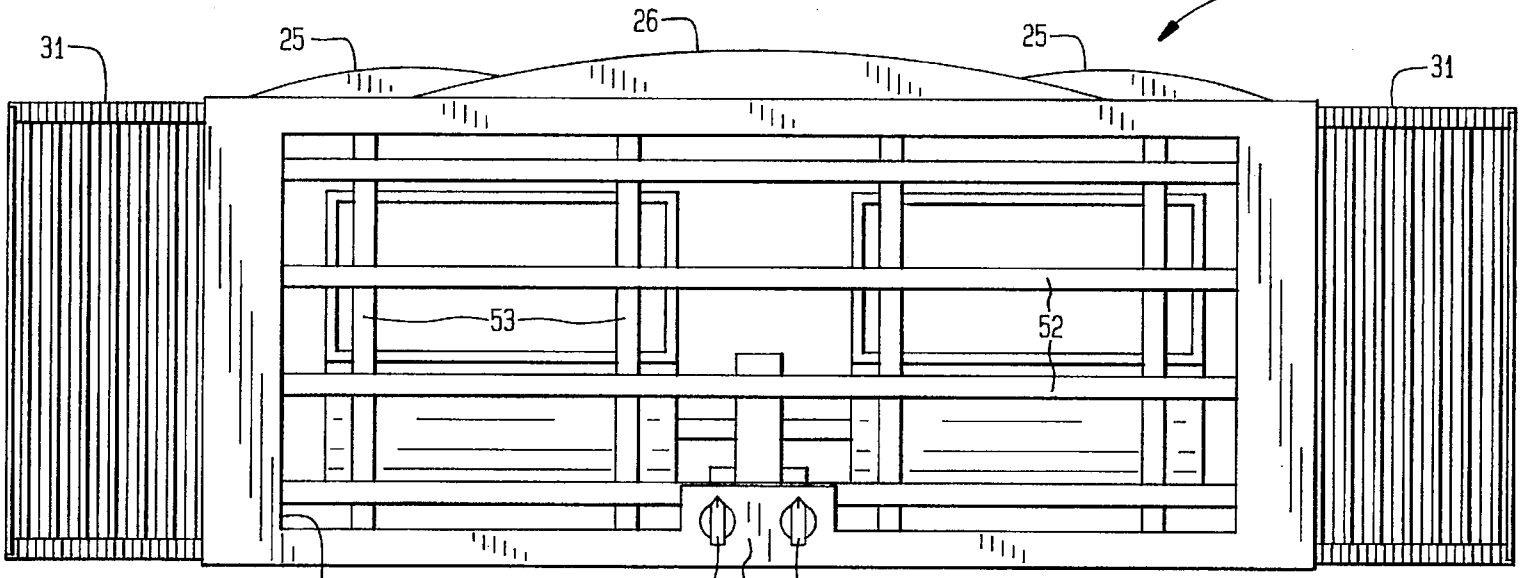
FIG. 2 is a front elevational view of the fan shown in FIG. 1.
Figure 6:
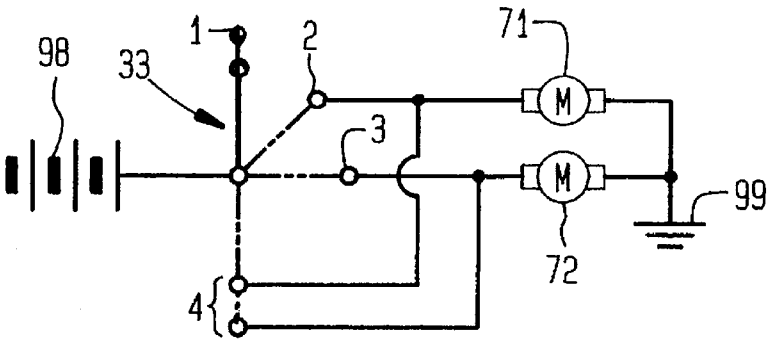
FIG. 6 is a schematic diagram of control circuit for the fan shown in FIG. 1.
Figure 4:
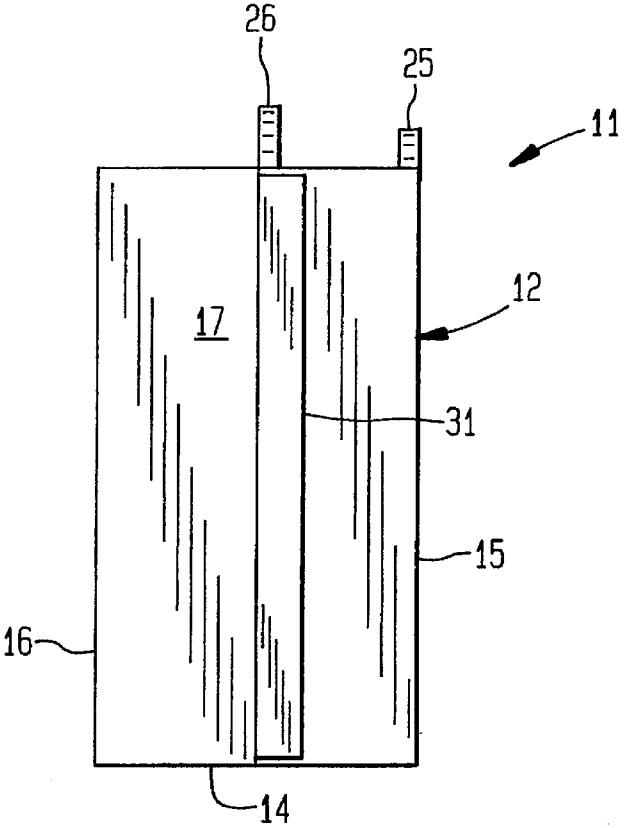
FIG. 4 is a right side view of the fan shown in FIG. 1.

Illustrated in FIG. 6 is a control circuit 97 for the fan 11. The circuit 97 includes the selector switch 33 which connects the drive motors 71 and 72 between a power supply 98 and ground 99. As schematically shown in FIG. 6, the switch 33 includes a first position in which the motors 71, 72 are deenergized, a second position in which only the motor 71 is energized, a third position in which only the motor 72 is energized and a fourth position in which both of the motors 71 and 72 are energized. Thus, selective actuation of the switch 33 can produce a first operational mode in which neither set of vanes 52, 53 oscillate, a second operational mode in which only the vertical vanes 53 oscillate, a third operational mode in which only the horizontal vanes 52 oscillate and a fourth operational mode in which both the horizontal vanes 52 and the vertical vanes 53 oscillate.

Prior to normal use of the fan 11, the housing 12 is mounted with the bottom wall 14 supported on a sill of an open window (not shown). The sash of the window then is lowered into engagement with the top wall 13 between the surfaces 29 of the rear tabs 25 and the surface 28 of the front tab 26 and the wing walls 31 are extended into engagement with the side surfaces of the window so as to fully close the opening therein. Selective actuation of the switch 34 then produces rotation of the blower wheels 44 at a desired speed and resultant flow of air through the inlet opening 21, the discharge openings 47 and the outlet opening 23. The air supplied by the blower wheels 45 is directed in continuously changing directions determined by selective actuation of the selector direction switch 33. In response to oscillation of the horizontal louvers 52, the supplied air is discharged in continuously changing vertical directions while in response to oscillation of the vertical vanes 53 the supplied air is discharged in continuously changing horizontal directions. In response to oscillation of both the horizontal vanes 52 and the vertical vanes 53, an air discharge pattern is provided that includes discharge in continuously varying both horizontal and vertical directions. Thus, the fan 11 provides through an open window an efficient air flow having a selectively variable extended discharge pattern.

Obviously, many modifications and variations of the present invention are possible in light of the above teachings. It is to be understood, therefore, that the invention can be practiced otherwise than as specifically described.

What is claimed is:

1. A portable electric window fan comprising:

a housing having inlet and outlet openings and adapted for mounting in an open window, said housing having side walls, a bottom wall for mounting on a sill of the window, a top wall for engaging a sash of the window, a front wall defining said air outlet opening, and a rear wall defining said air inlet opening and wherein said top wall defines spaced apart surfaces for straddling the window sash;

a wing wall extendable out of each of said side walls;

a movable blade mechanism retained in said housing and operable to supply air through the open window between said inlet and outlet openings;

a blade drive operatively coupled to said blade mechanism;

a movable air director means for directing in variable horizontal and vertical directions air supplied by said blower mechanism; and an air director drive means operatively coupled to said air director mechanism and operable to automatically vary said discharge directions.

2. A fan according to claim 1 wherein said air director means comprises a plurality of movable air director vanes.

3. A fan according to claim 2 wherein said air director vanes comprise a plurality of spaced apart vertically oriented vanes mounted for horizontal oscillating movement.

4. A fan according to claim 2 wherein said air director vanes comprise a plurality of spaced apart horizontally oriented vanes mounted for vertical oscillating movement.

5. A fan according to claim 4 wherein said air director vanes comprise a plurality of spaced apart vertically oriented vanes mounted for horizontal oscillating movement.

6. A fan according to claim 5 including a control for selectively activating said air director drive means to independently activate said vertically oriented vanes and said horizontally oriented vanes.

7. A fan according to claim 6 wherein said air director drive means comprises a vertical drive motor for producing said vertical oscillating movement of said horizontally oriented vanes and a horizontal drive motor for producing said horizontal oscillating movement of said vertically oriented vanes, and said control comprises an electrical circuit for selectively and independently energizing said vertical drive motor and said horizontal drive motor.

8. A fan according to claim 6 including a frame retained within said housing, said frame supporting said vertically oriented vanes and said horizontally oriented vanes in juxtaposition between said inlet and said outlet openings.

9. A fan according to claim 8 wherein said vertically oriented vanes are disposed between said inlet opening and said horizontally oriented vanes.

* * * * *